US007937866B1

(12) United States Patent
Brown

(10) Patent No.: US 7,937,866 B1
(45) Date of Patent: May 10, 2011

(54) AUTOMOBILE DISPLAY APPARATUS

(76) Inventor: Dennis Brown, Charlotte, NC (US)

( * ) Notice: Subject to any disclaimer, the term of this patent is extended or adjusted under 35 U.S.C. 154(b) by 93 days.

(21) Appl. No.: 12/535,446

(22) Filed: Aug. 4, 2009

(51) Int. Cl.
*G09F 13/00* (2006.01)

(52) U.S. Cl. ..... 40/591; 40/600

(58) Field of Classification Search ..... 40/591, 40/600, 593, 621, 643, 661.01; 116/63 P, 116/63 T See application file for complete search history.

(56) References Cited

U.S. PATENT DOCUMENTS

| | | | | | |
|---|---|---|---|---|---|
| 3,124,501 | A | * | 3/1964 | Wise | 428/167 |
| 3,670,438 | A | * | 6/1972 | Carroll et al. | 40/600 |
| 4,059,912 | A | | 11/1977 | Noah | |
| 4,838,793 | A | * | 6/1989 | Taylor | 434/168 |
| 4,950,023 | A | * | 8/1990 | Waller et al. | 296/153 |
| 5,156,274 | A | | 10/1992 | Williams, Jr. | |
| 5,398,437 | A | * | 3/1995 | Bump et al. | 40/582 |
| 5,622,389 | A | | 4/1997 | Courtney | |
| D382,018 | S | | 8/1997 | Washington | |
| 5,878,516 | A | | 3/1999 | Amirian | |
| 6,217,958 | B1 | | 4/2001 | Blyden et al. | |
| 6,446,571 | B1 | * | 9/2002 | Sloot | 116/63 P |
| 6,449,889 | B1 | | 9/2002 | Hottenstein | |
| 2004/0016160 | A1 | | 1/2004 | Hudgins | |
| 2005/0108910 | A1 | | 5/2005 | Esparza et al. | |
| 2008/0189999 | A1 | * | 8/2008 | Peterman | 40/593 |

* cited by examiner

*Primary Examiner* — Cassandra Davis

(74) *Attorney, Agent, or Firm* — Crossley Patent Law; Mark A. Crossley

(57) ABSTRACT

The automobile display apparatus provides a triangular caution that easily attaches to and detaches from an automobile driven by a new driver. The apparatus, most importantly, attaches without damage to the auto but also insures that detachment is by choice only. The majority of the apparatus is fully flexible, thereby further improving adhesion. The inverted triangle is easily recognized as a cautionary symbol. Part of the reflective indicia is designed to progressively become a recognized symbol for a new driver so that the printed words may be omitted, by choice, in the future. Additionally, the indicia of the young person in the car serve the same purpose as an identifiable symbol to most motorists of a new or young driver. Identifying the driver as new encourages other motorists in the vicinity to be cautious and to also adapt a more courteous posture toward the new driver.

4 Claims, 7 Drawing Sheets

AUTOMOBILE DISPLAY APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

As testimony to the effectiveness of warning other motorists of new and beginning drivers, driver education vehicles have long been equipped with caution signs. Typically, these are large signs that mount permanently or almost permanently either on top or on the front and/or rear of the educational vehicle. However, graduation from a driver education class does not an experienced driver make. Typically, a neophyte driver remains such for many months if not longer. But, individuals do not usually want to permanently mount a caution of "new driver" to a family or personally owned and driven vehicle, especially if an experienced driver is usually at the wheel. Consequently, other devices have been proposed for use on personal automobiles. Some such caution devices are stick-on, a fact that deters many from use, as many automobile owners object to stickers on their cars for several reasons. Some devices provide lighted caution, which is also undesirable to some and also adds expense and need of service. Some automotive display devices are entirely of magnetic sheet. Such devices have proven prone to adhesion failure due to lack of conformity to anything but a continuously flat surface. The present apparatus provides a uniquely inverted triangle that can be magnetically temporarily mounted or mounted via restriction within an opening such as a hood or trunk, then removed at any time with no real effort.

FIELD OF THE INVENTION

The automobile display apparatus relates to automobile display devices and more especially to an easily attached and detached inverted triangular automobile display apparatus that cautions other motorists and pedestrians of the presence of a new driver.

SUMMARY OF THE INVENTION

The general purpose of the automobile display apparatus, described subsequently in greater detail, is to provide a automobile display apparatus which has many novel features that result in an improved automobile display apparatus which is not anticipated, rendered obvious, suggested, or even implied by prior art, either alone or in combination thereof.

To attain this, the automobile display apparatus provides a triangular caution that easily attaches to and detaches from an automobile driven by a new driver. The apparatus, most importantly, attaches without damage to the auto but also insures that detachment is by choice only. The majority of the apparatus is fully flexible, thereby further improving adhesion. The inverted triangle is easily recognized as a cautionary symbol. Part of the reflective indicia is designed to progressively become a recognized symbol for a new driver so that the printed words may be omitted, by choice, in the future. Additionally, the indicia of the young person in the car serve the same purpose as an identifiable symbol to most motorists of a new or young driver. Identifying the driver as new encourages other motorists in the vicinity to be cautious and to also adapt a more courteous posture toward the new driver. With more than one embodiment provided, most automobiles can be properly equipped. While the apparatus is supplied in standard with two copies, one individual apparatus is also available.

Thus has been broadly outlined the more important features of the improved automobile display apparatus so that the detailed description thereof that follows may be better understood and in order that the present contribution to the art may be better appreciated.

An object of the automobile display apparatus is to caution other motorists of a new driver operating an automobile.

Another object of the automobile display apparatus is to provide an inverted triangular shape that is universally recognized in warnings.

A further object of the automobile display apparatus is to easily and temporarily attach to an automobile.

An added object of the automobile display apparatus is to prevent any damage to the auto to which the apparatus is temporarily affixed.

And, an object of the automobile display apparatus is to provide more than one means for temporary attachment to an automobile.

Yet another object of the automobile display apparatus is to provide indicia that may be progressively more recognized as a symbol for a new driver.

Still another object of the automobile display apparatus is to ensure that the apparatus does not come off during driving of the automobile to which it is attached.

These together with additional objects, features and advantages of the improved automobile display apparatus will be readily apparent to those of ordinary skill in the art upon reading the following detailed description of presently preferred, but nonetheless illustrative, embodiments of the improved automobile display apparatus when taken in conjunction with the accompanying drawings.

In this respect, before explaining the current embodiments of the improved automobile display apparatus in detail, it is to be understood that the automobile display apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved automobile display apparatus. It is therefore important that the claims be regarded as including such equivalent constructions insofar as they do not depart from the spirit and scope of the automobile display apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the automobile display apparatus generally designated by the reference number 10 will be described.

Figure 5:
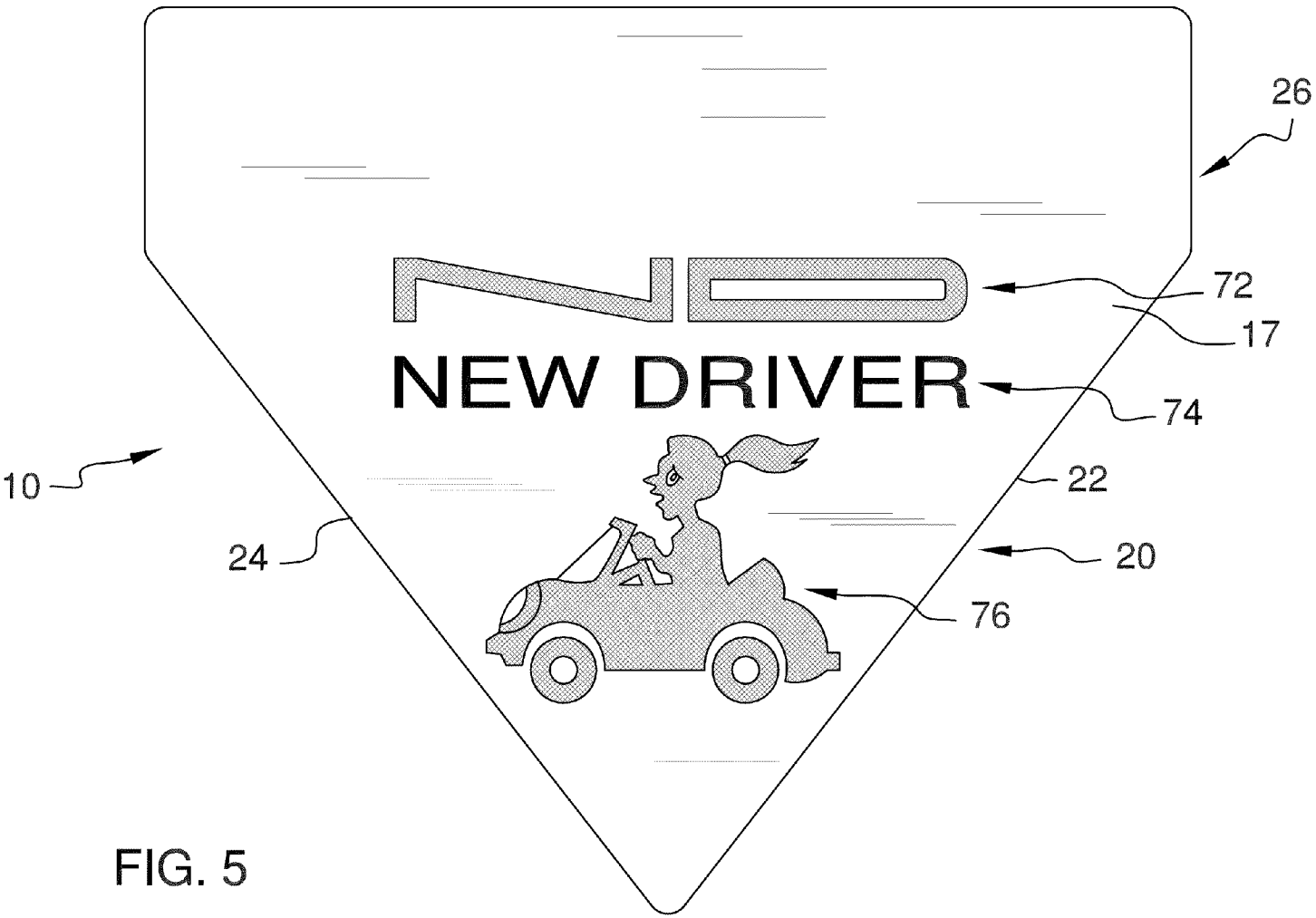
FIG. 5 is a front elevation view of the embodiment of FIG. 4.
Figure 6:
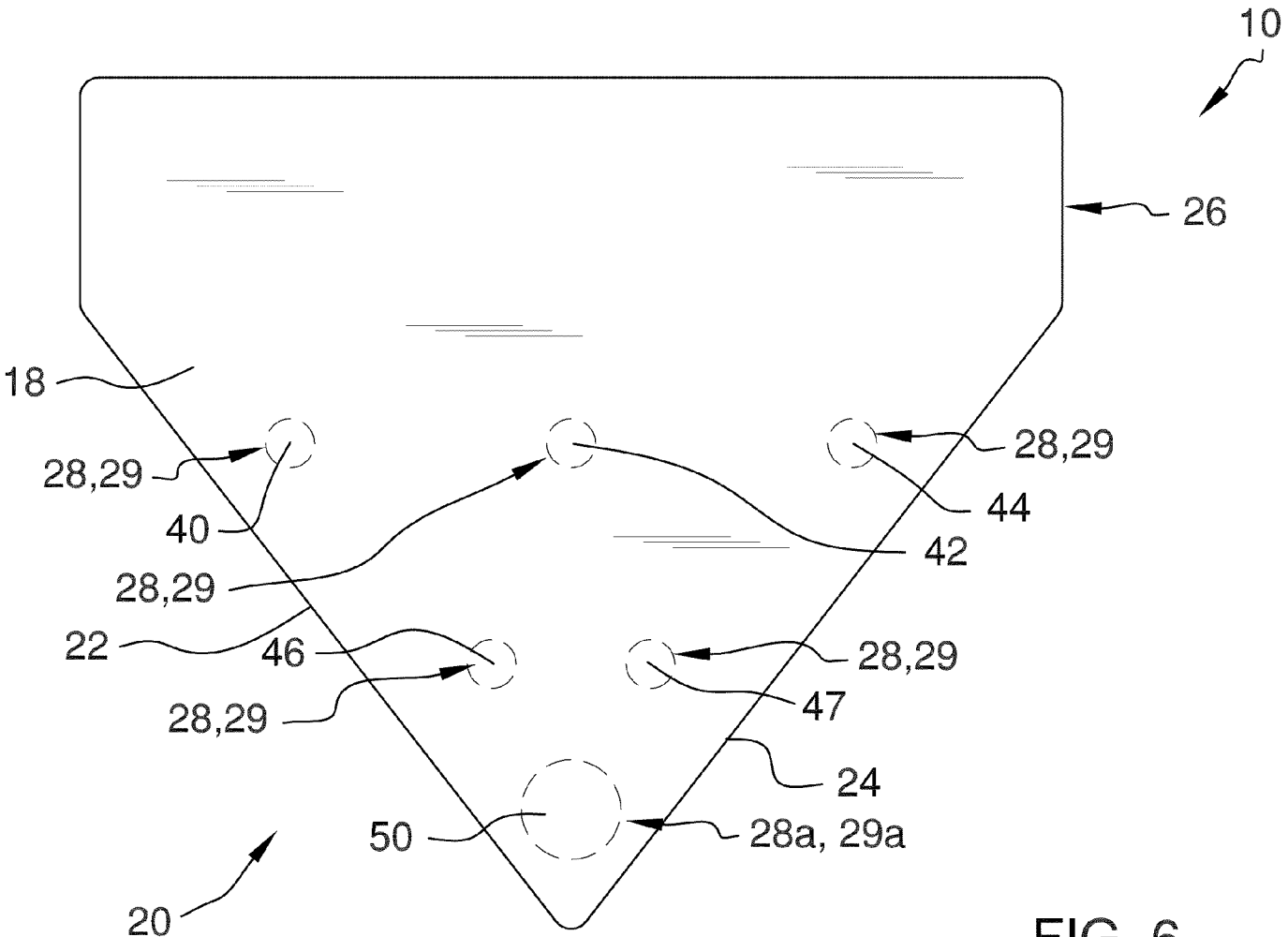
FIG. 6 is a back elevation view of the embodiment of FIGS. 4 and 5.
Figure 7:
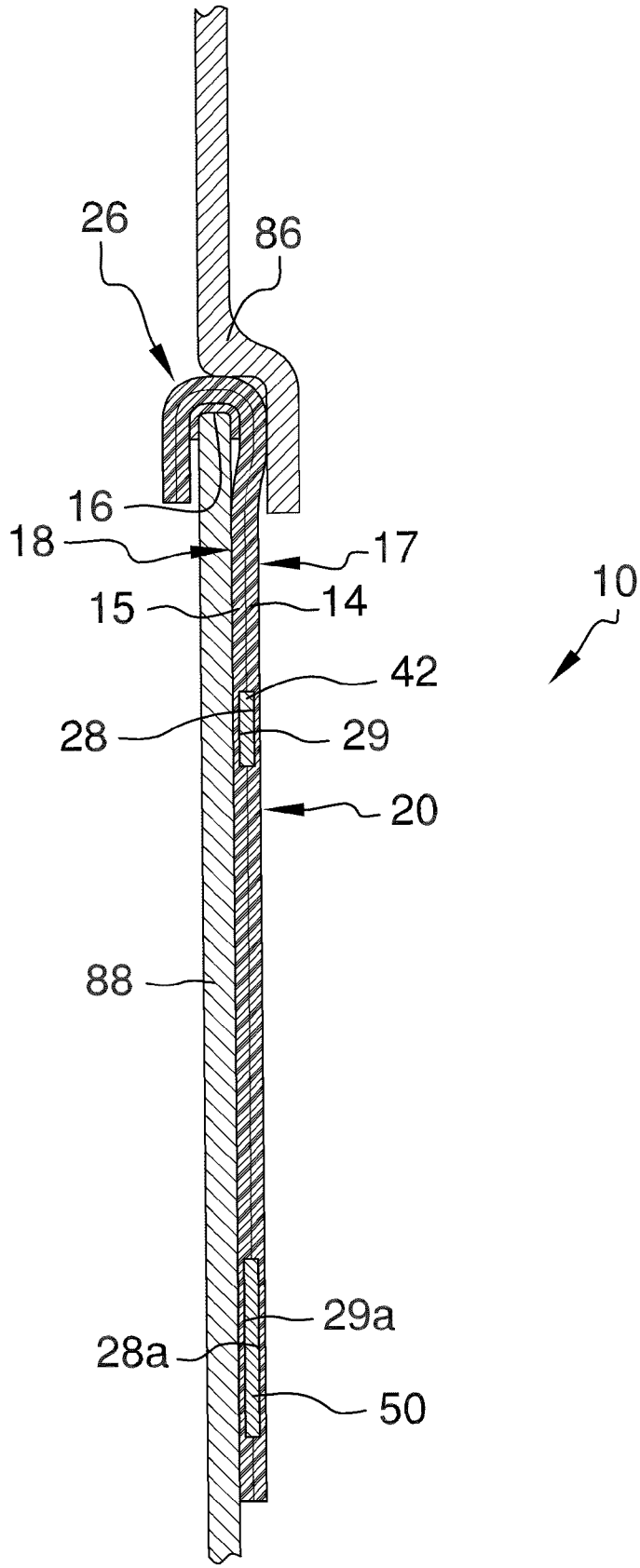
FIG. 7 is a cross sectional view of FIG. 4, taken along the line 7-7.

Referring to FIGS. 5, 6, and 7, the automobile display apparatus 10 partially comprises the inverted triangle 20 of flexible material having a first layer 14 affixed to a second layer 15. The top side 21 is connected to the first side 22. The second side 24 is connected to the top side 21 and the first side 22. The flexible rectangular top flap 26 is continued from the top side 21 of each layer. The triangle 20 of material and the top flap 26 combine to form a front 17 and a back 18. The inverted triangle 20 is important in that the shape is recognized almost universally as a caution of some kind. A flexible reinforcement/cushion layer 16 is affixed to the back 18 of the second layer 15. The reinforcement cushion layer 16 is selectively closed between an opening portal such as a trunk lid 86 of an automobile 80 and a fixed member such as a trunk 88 of the automobile 80.

Continuing to refer to FIGS. 5, 6, and 7, a plurality of circular magnets is disposed between the first layer 14 and the second layer 15. Each magnet is disposed within a magnet pocket of like shape and size to one of the magnets. The pockets comprise first layer pockets 28 and second layer pockets 29. The pockets are important in that the first layer 14 and the second layer 15 are made of a thickness of material that provides durable use in conditions in which the apparatus is used. By decreasing the thicknesses of the materials at the pockets, the magnets can not only adhere better to metal but also be included between the layers without bulges. The magnets comprise a trio of evenly spaced apart central magnets comprising a first central magnet 40 spaced apart from a second central magnet 42 spaced apart from a third central magnet 44. The central magnets are disposed in a horizontal line parallel to the top side 21.

A pair of spaced apart lower magnets is disposed in a horizontal line spaced apart from the central magnets. The lower magnets comprise the first lower magnet 46 and the second lower magnet 47. The circular weight 50 is disposed between the first layer 14 and the second layer 15, the weight 50 proximal to the first side 22 and the second side 24. The weight 50 is sized and positioned to hold the triangle 20 down and proximal to the automobile 80 when encountering turbulence. Reflective indicia 70 are disposed on the front 17 of the triangle 20.

Referring again to FIG. 5, the optionally reflective indicia 70 comprises an ND 72 disposed proximal to the top side 21 of the triangle 20. NEW DRIVER 74 is disposed below the ND 72. With widespread usage, the ND 72 is proposed to be almost universally and thereby negate the use of NEW DRIVER 74 portion of the indicia 70. A young person in a convertible car 76 is disposed below the NEW DRIVER 74. The young person in a convertible car 76 further clarifies the indicia 70, especially for those who cannot read.

Figure 4:
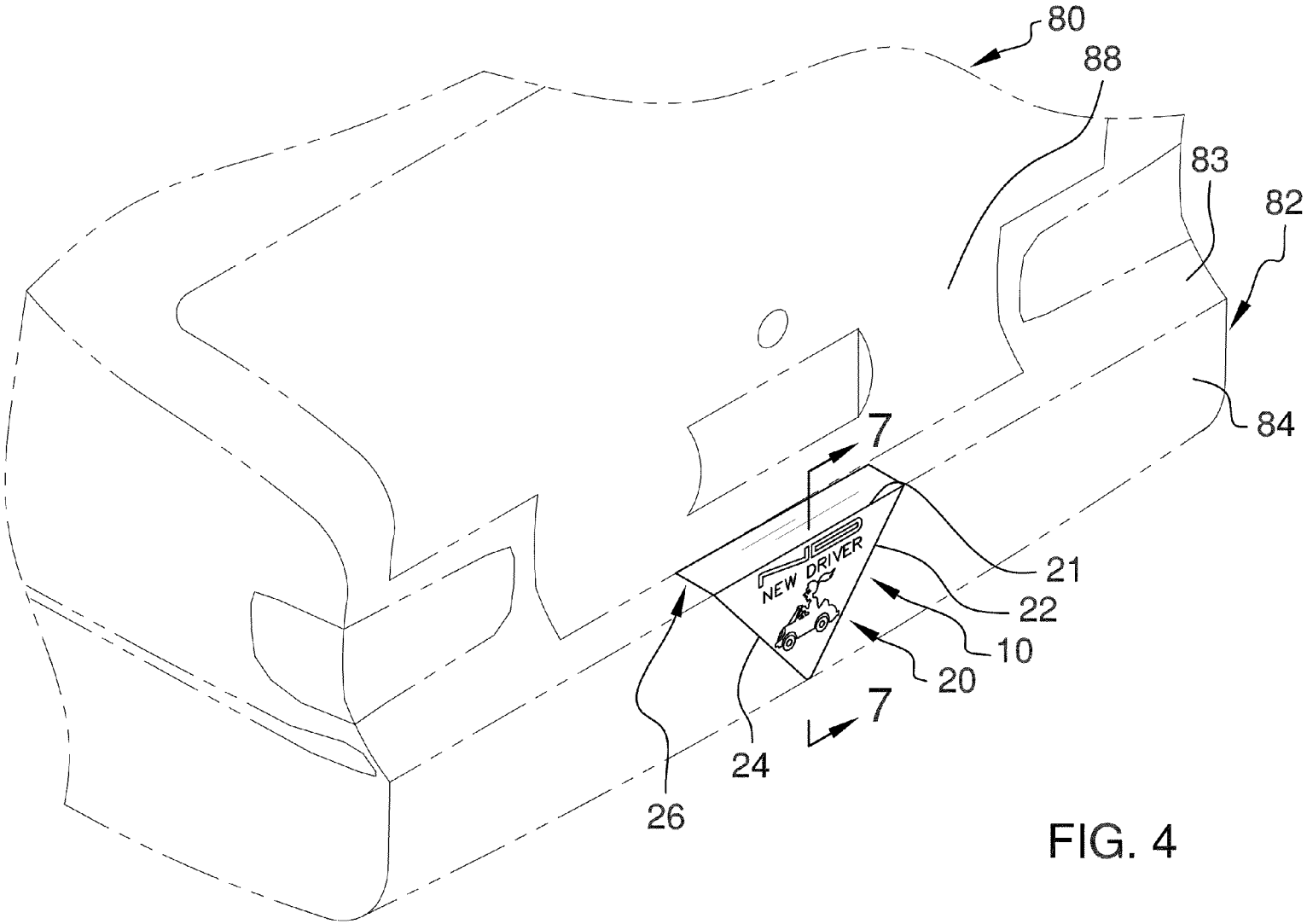
FIG. 4 is a perspective view of an installed alternate embodiment.

Referring to FIG. 4, part of the top flap 26 is disposed on the bumper top 83. The triangle 20 is disposed on the bumper face 84 of the bumper 82.

Figure 1:
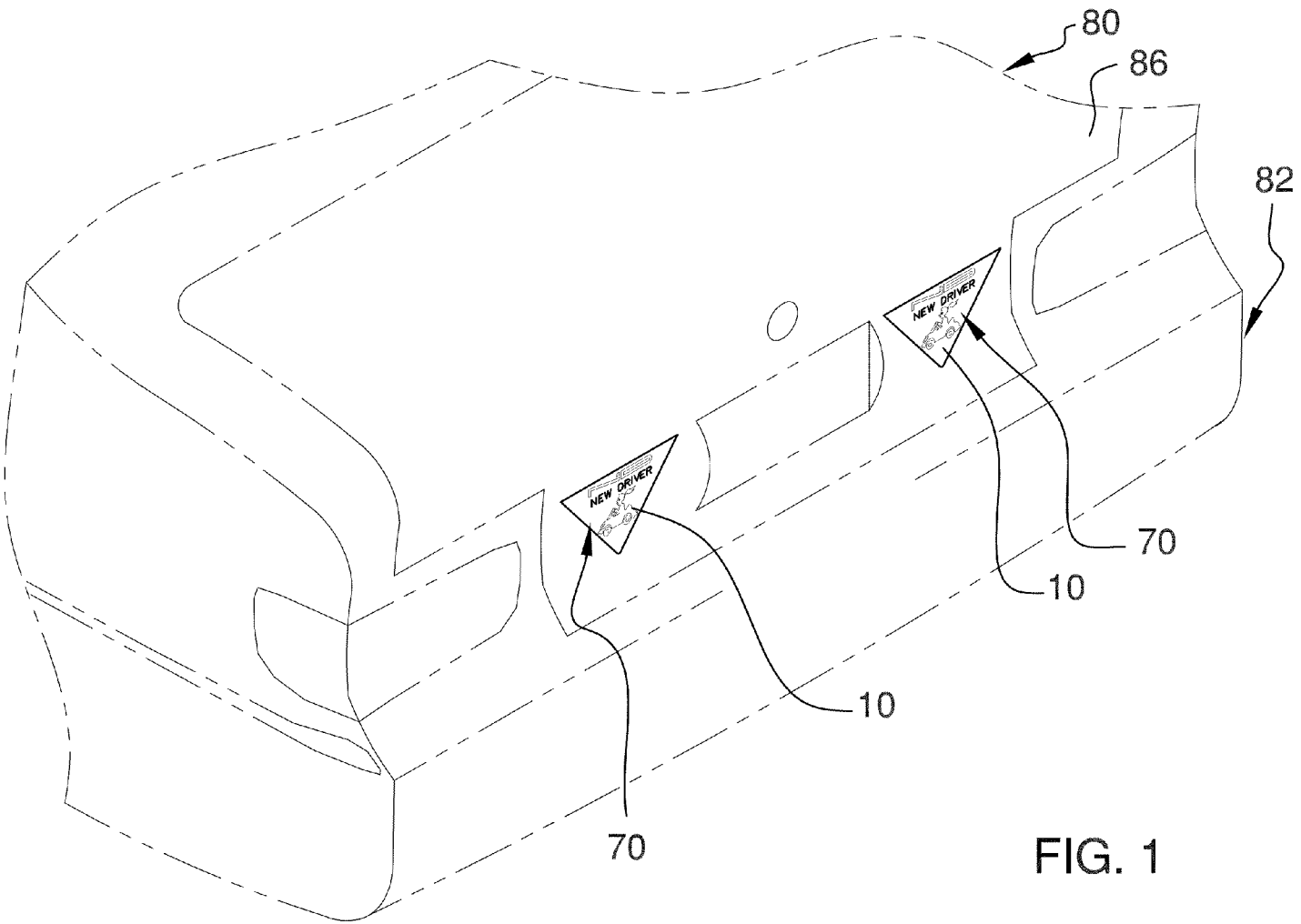
FIG. 1 is a perspective view of an embodiment temporarily affixed to an automobile.
Figure 2:
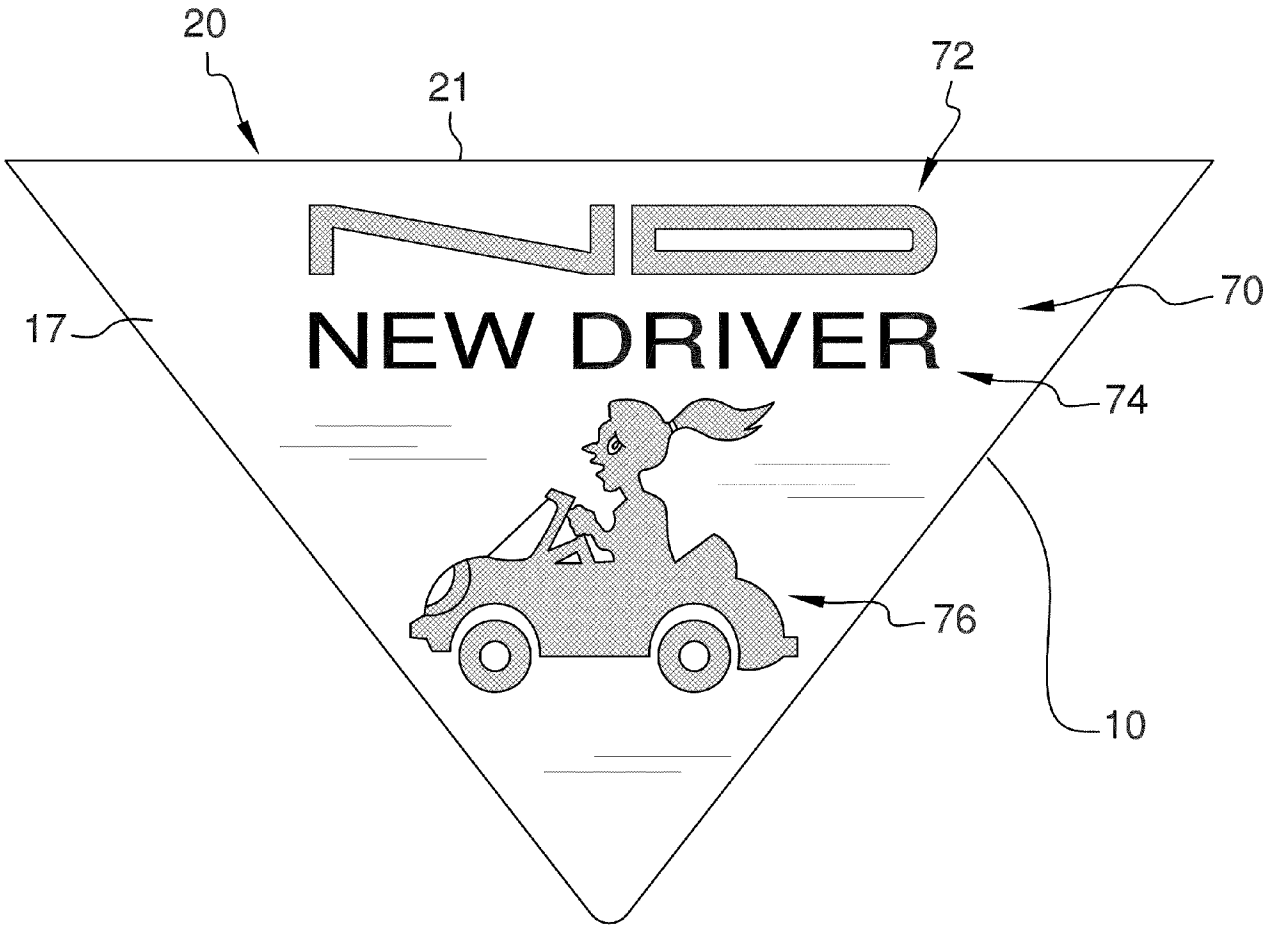
FIG. 2 is a front elevation view of the embodiment of FIG. 1.
Figure 3:
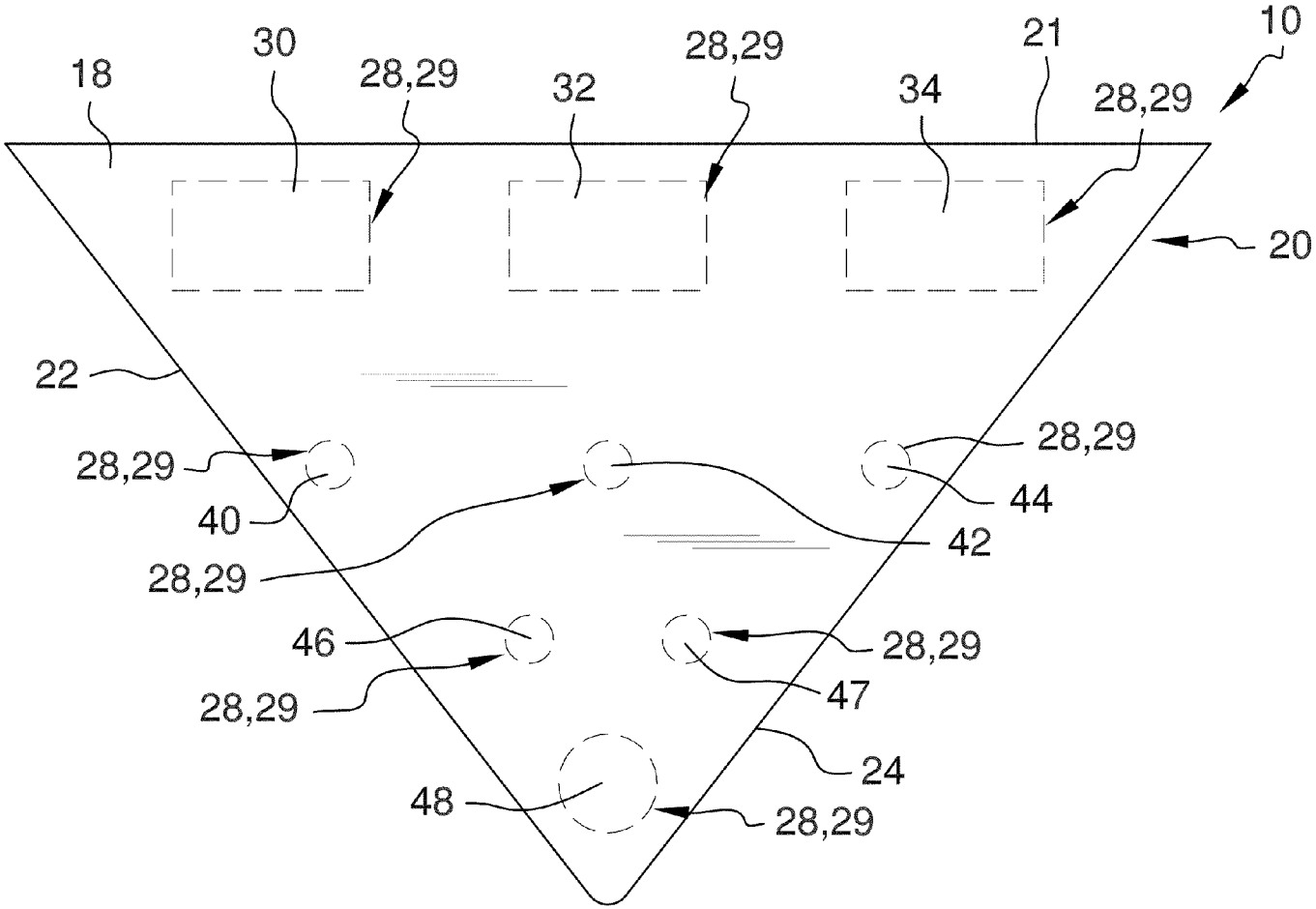
FIG. 3 is a back elevation view of the embodiment of FIGS. 1 and 2.

Referring to FIGS. 1, 2, and 3, the alternate embodiment of the apparatus partially comprises the inverted triangle 20 of flexible material having a first layer 14 affixed to a second layer 15. The top side 21 is connected to the first side 22. The second side 24 is connected to the top side 21 and the first side 22.

Referring specifically to FIG. 3, a plurality of magnets is disposed between the first layer 14 and the second layer 15. Each magnet is disposed within a magnet pocket comprising a plurality of first layer pockets 28 and a plurality of second layer pockets 29. Each pocket is of like shape and size to each magnet therein. The magnets comprise a trio of evenly spaced apart rectangular magnets disposed horizontally proximal to the top side 21. The trio comprises the first upper magnet 30, the second upper magnet 32, and the third upper magnet 34. The magnets also comprise the trio of evenly spaced apart central magnets comprising a first central magnet 40 spaced apart from a second central magnet 42 spaced apart from a third central magnet 44. The central magnets are disposed in a horizontal line parallel to the top side 21. A pair of spaced apart lower magnets is disposed in a horizontal line parallel to the top side 21. The lower magnets are spaced apart from the central magnets. The lower magnets comprise a first lower magnet 46 and a second lower magnet 47. The bottom magnet 48 is disposed between the first layer 14 and the second layer 15. The bottom magnet 48 is proximal to the first side 22 and the second side 24. The bottom magnet 48 is larger than the central magnets and the lower magnets. The size and dispersion of the magnets is important for more than one reason. First, the plurality of magnets and magnet shapes best allows a high number of magnets substantially dispersed throughout the triangle 20. This is important in adherence to an automobile 80. Second, a plurality of dispersed magnets provides that scuffmarks do not occur on the metal surface of the automobile 80. Conversely, a minimal number of magnets has been shown to quickly wear a surface, especially a painted one.

Referring to FIGS. 1 and 2, optionally reflective indicia 70 are disposed on the front 17 of the triangle 20. The indicia 70 are identical to that of the first embodiment of the apparatus 10. The indicia 70 therefore comprise the ND 72 disposed proximal to the top side 21 of the triangle 20. The NEW DRIVER 74 is disposed below the ND 72. The young person in a convertible car 76 is disposed below the NEW DRIVER 74.

With respect to the above description then, it is to be realized that the optimum dimensional relationships for the parts of the automobile display apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the automobile display apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the automobile display apparatus may be used.

Therefore, the foregoing is considered as illustrative only of the principles of the automobile display apparatus. Further, since numerous modifications and changes will readily occur to those skilled in the art, it is not desired to limit the automobile display apparatus to the exact construction and operation shown and described, and accordingly, all suitable modifications and equivalents may be resorted to, falling within the scope of the automobile display apparatus.

What is claimed is:

1. An automobile display apparatus, comprising:

an inverted triangle of flexible material having a first layer affixed to a second layer, a top side connected to a first side, a second side connected to the top side and the first side;

a flexible rectangular top flap continued from the top side of each layer, the triangle of material and the top flap having a front and a back;

a flexible reinforcement/cushion layer affixed to the back of the second layer, the reinforcement cushion layer selectively closed between an opening portal of an automobile and a fixed member of the automobile;

a plurality of circular magnets disposed between the first layer and the second layer, each magnet disposed within a pocket of like shape to each magnet, each pocket of a plurality of first layer pockets and second layer pockets, the magnets comprising:

a trio of evenly spaced apart central magnets comprising a first central magnet spaced apart from a second central magnet spaced apart from a third central magnet, the central magnets in a horizontal line parallel to the top side;

a pair of spaced apart lower magnets disposed in a horizontal line parallel to the top side, the lower magnets spaced apart from the central magnets, the lower magnets comprising a first lower magnet and a second lower magnet;

a circular weight disposed below the lower magnets, the circular weight disposed between the first layer and the second layer, the weight proximal to the first side and the second side;

an indicia disposed on the front of the triangle, the indicia comprising:

an ND disposed proximal to the top side of the triangle;

a NEW DRIVER disposed below the ND;

a young person in a convertible car disposed below the NEW DRIVER.

2. The apparatus according to claim 1 wherein the indicia are further reflective.

3. An automobile display apparatus, comprising:

an inverted triangle of flexible material having a first layer affixed to a second layer, a top side connected to a first side, a second side connected to the top side and the first side;

a plurality of magnets disposed between the first layer and the second layer, each magnet disposed within a pocket of like shape to each magnet, each pocket of a plurality of first layer pockets and second layer pockets of the layers, the magnets comprising:

a trio of evenly spaced apart rectangular magnets disposed horizontally proximal to the top side, the trio comprising the first upper magnet, the second upper magnet, the third upper magnet;

a trio of evenly spaced apart central magnets comprising a first central magnet spaced apart from a second central magnet spaced apart from a third central magnet, the central magnets in a horizontal line parallel to the top side, the central magnets below and spaced apart from the upper magnets;

a pair of spaced apart lower magnets disposed in a horizontal line parallel to the top side, the lower magnets spaced apart from the central magnets, the lower magnets comprising a first lower magnet and a second lower magnet;

a circular weight disposed between the first layer and the second layer, the weight proximal to the first side and the second side, the weight disposed within a first layer weight pocket and a second layer weight pocket of like shape to the weight;

an indicia disposed on the front of the triangle, the indicia comprising:

an ND disposed proximal to the top side of the triangle;

a NEW DRIVER disposed below the ND;

a young person in a convertible automobile disposed below the NEW DRIVER.

4. The apparatus according to claim 3 wherein the indicia disposed on the front of the triangle are further reflective.

* * * * *